US007913430B2

(12) United States Patent
Männikkö

(10) Patent No.: US 7,913,430 B2
(45) Date of Patent: Mar. 29, 2011

(54) SCREENING, CRUSHING OR MIXING BUCKET

(75) Inventor: Ari Männikkö, Nastola (FI)

(73) Assignee: Allu Finland Oy, Orimattila (FI)

( * ) Notice: Subject to any disclaimer, the term of this patent is extended or adjusted under 35 U.S.C. 154(b) by 0 days.

(21) Appl. No.: 12/835,893

(22) Filed: Jul. 14, 2010

(65) Prior Publication Data

US 2011/0010968 A1 Jan. 20, 2011

(30) Foreign Application Priority Data

Jul. 14, 2009 (FI) ..... 20095789

(51) Int. Cl.
*E02F 3/40* (2006.01)
*B02C 13/20* (2006.01)

(52) U.S. Cl. ..... 37/403; 241/101.72

(58) Field of Classification Search ..... 37/403–413, 37/466, 468, 444, 446, 445, 379, 341; 241/101.72, 241/101.742, 189.1, 191, 236, 190
See application file for complete search history.

(56) References Cited

U.S. PATENT DOCUMENTS

| | | | | |
|---|---|---|---|---|
| 5,485,689 | A | 1/1996 | Jonninen | |
| 5,619,811 | A * | 4/1997 | Yrjola | 37/466 |
| 5,887,810 | A * | 3/1999 | Maruyama | 241/189.1 |
| 6,237,865 | B1 | 5/2001 | Luttermann et al. | |
| 7,284,345 | B2 * | 10/2007 | Schenk | 37/403 |
| 7,506,461 | B2 * | 3/2009 | Jonninen | 37/403 |

FOREIGN PATENT DOCUMENTS

| | | | |
|---|---|---|---|
| DE | 100 64 149 | A1 | 7/2002 |
| DE | 20 2006 005 070 | U1 | 6/2006 |
| GB | 2 401 096 | A | 11/2004 |
| WO | WO 91/18152 | A1 | 11/1991 |
| WO | WO 94/00644 | A1 | 1/1994 |
| WO | WO 01/58595 | A1 | 8/2001 |

OTHER PUBLICATIONS

Finnish Search Report for Finnish Application No. 20095789, dated May 20, 2010, English translation with original Finnish language document attached.

* cited by examiner

*Primary Examiner* — Robert E Pezzuto
(74) *Attorney, Agent, or Firm* — Sterne, Kessler, Goldstein & Fox, P.L.L.C.

(57) ABSTRACT

A screening, crushing or mixing bucket which is designed as the bucket of an excavating machine or a bucket loader, comprising a bottom plate (1), side walls (2), and working drums (3), which are rotatable about their axes at a rear part of the bucket and which, while in rotation, effect screening, crushing or mixing of a material present in the bucket and at the same time delivering of a screened, crushed or mixed material out of the bucket between or through the working drums (3). The bucket also includes enclosures (4) for a transmission and bearing assemblies of the working drums (3), said enclosures being defined by frame panels (5) capable of being fitted with bearing cups (6) for the drums (3). Tool flanges (11) are provided with a butt collar or butt expansion (12*a*), extending around the drum shaft (9, 10) and dimensioned in the drum shaft direction in such a way that, with the tool flanges (11) at a desired distance from each other, between the butt collars (12*a*) remains a gap (s) for a welded joint. Two tool flanges (11) and the drum shaft (9, 10) are attached together by a single welded joint present in the gap (s).

10 Claims, 3 Drawing Sheets

SCREENING, CRUSHING OR MIXING BUCKET

BACKGROUND OF THE INVENTION

1. Field of the Invention

The invention relates to a screening, crushing or mixing bucket, which is designed as the bucket of an excavating machine or a bucket loader, comprising a bottom plate, side walls, and working drums, which are rotatable about their axes at a rear part of the bucket and which, while in rotation, effect screening, crushing or mixing of a material present in the bucket and at the same time delivering of a screened, crushed or mixed material out of the bucket between or through the working drums, as well as enclosures for a transmission and bearing assemblies of the working drums, said enclosures being defined by frame panels capable of being fitted with bearing cups for the drums, the working drums including a drum shaft and tool flanges fastened to the drum shaft by welding.

2. Background Art

This type of bucket is known from the Applicant's international patent application WO 0158595. A problem with this prior known bucket is the attachment of tool flanges as the space between tool flanges is very small from the standpoint of welding. In practice, the welding operation is only possible from one side of a tool flange, resulting in a not particularly high quality welded joint.

BRIEF SUMMARY OF THE INVENTION

An object of the invention is to provide a bucket of the above-described type, which is not hampered by the foregoing problems.

This object is accomplished according to the invention on the basis of the characterizing features presented in claim 1. Preferred embodiments of the invention are presented in the dependent claims.

BRIEF DESCRIPTION OF THE DRAWINGS/FIGURES

One exemplary embodiment of the invention will now be described more closely with reference to the accompanying drawings, in which.

Figure 5:
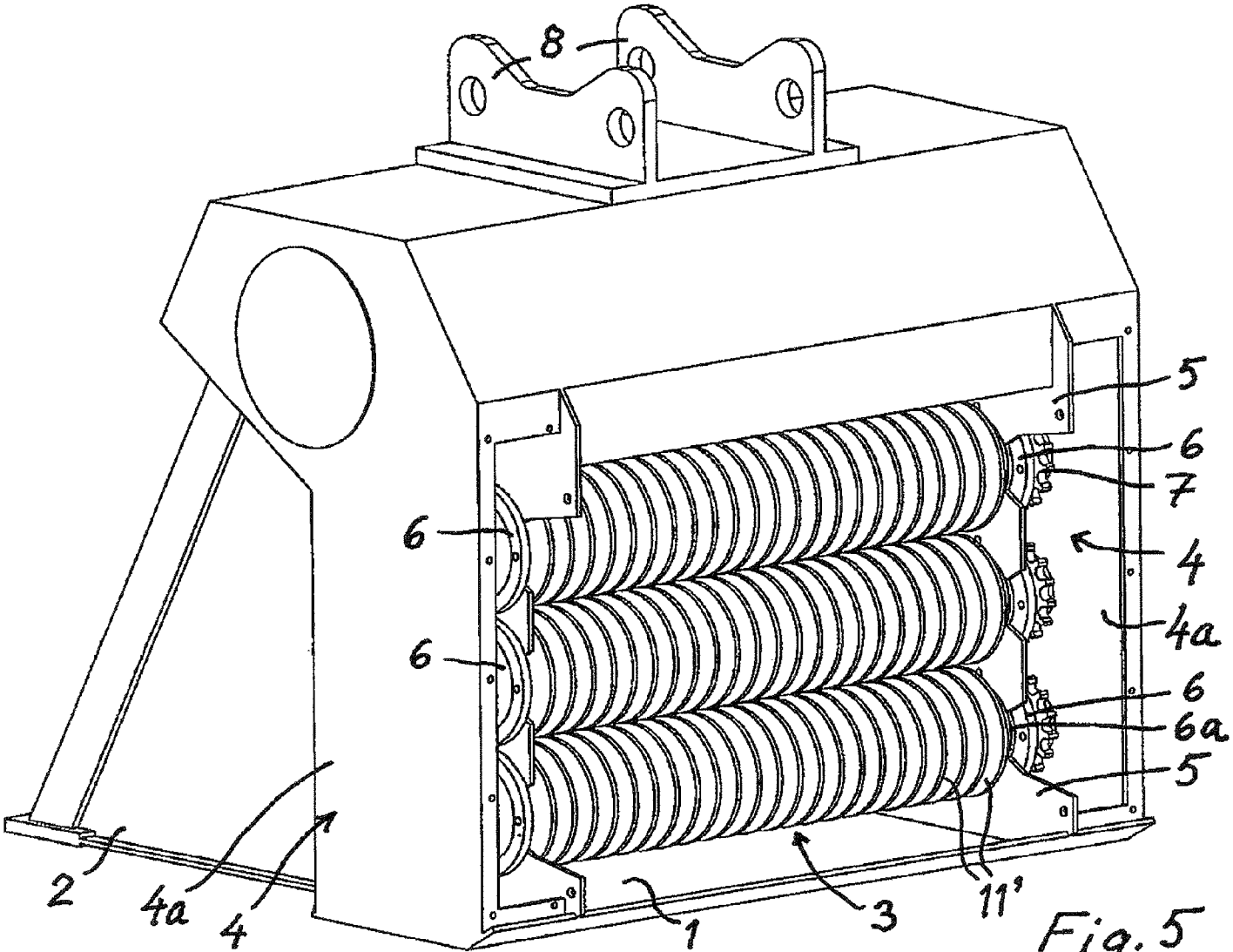

FIG. 5 shows a bucket of the invention with working drums 3 installed in place. Transmission enclosures are cut partially open. Tool flanges are presented as circular discs, thus enabling the attachment of tool bits in desired shapes between the same.

DETAILED DESCRIPTION OF THE INVENTION

The bucket according to the invention (FIG. 5) can be coupled for an excavator or bucket loader shovel, which is why the bucket has attachment brackets 8 on its top side.

Figure 1:
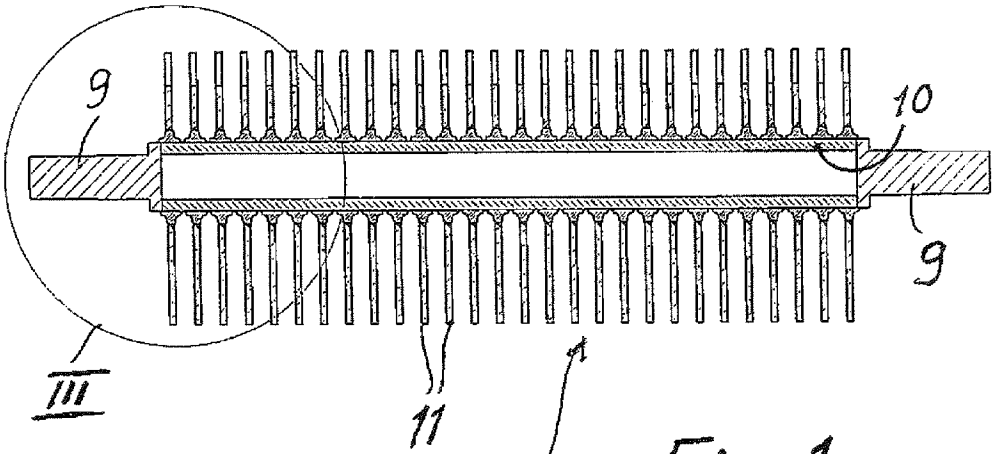
FIG. 1 shows a working drum for a bucket of the invention in an axial section along a line I-I in FIG. 2.
Figure 2:
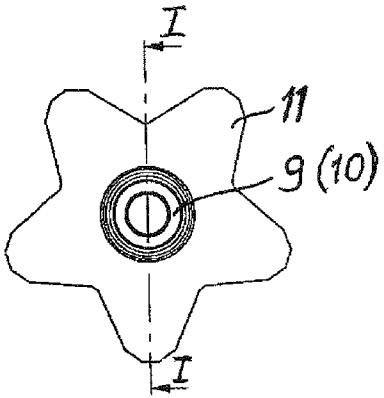
FIG. 2 shows the same working drum in an end view.
Figure 4:
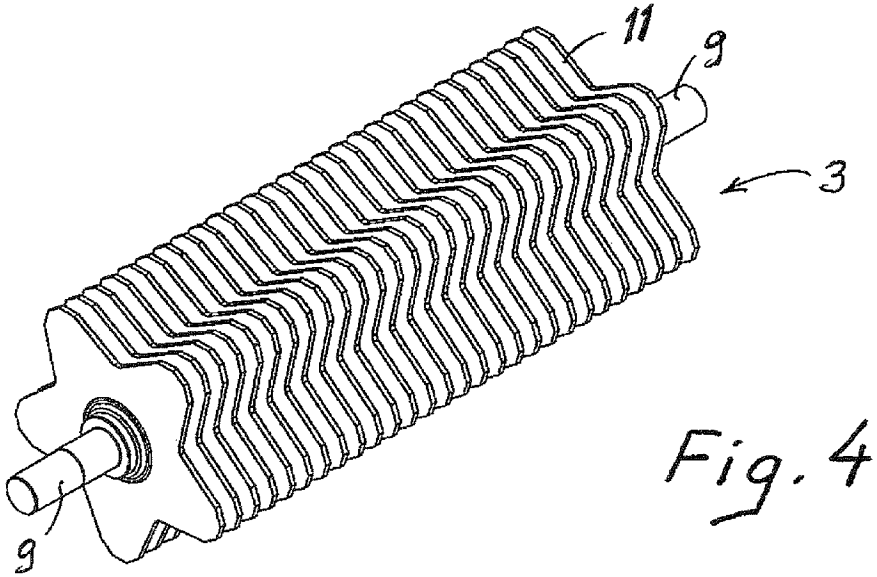
FIG. 4 shows the same working drum in a perspective view.
Figure 3:
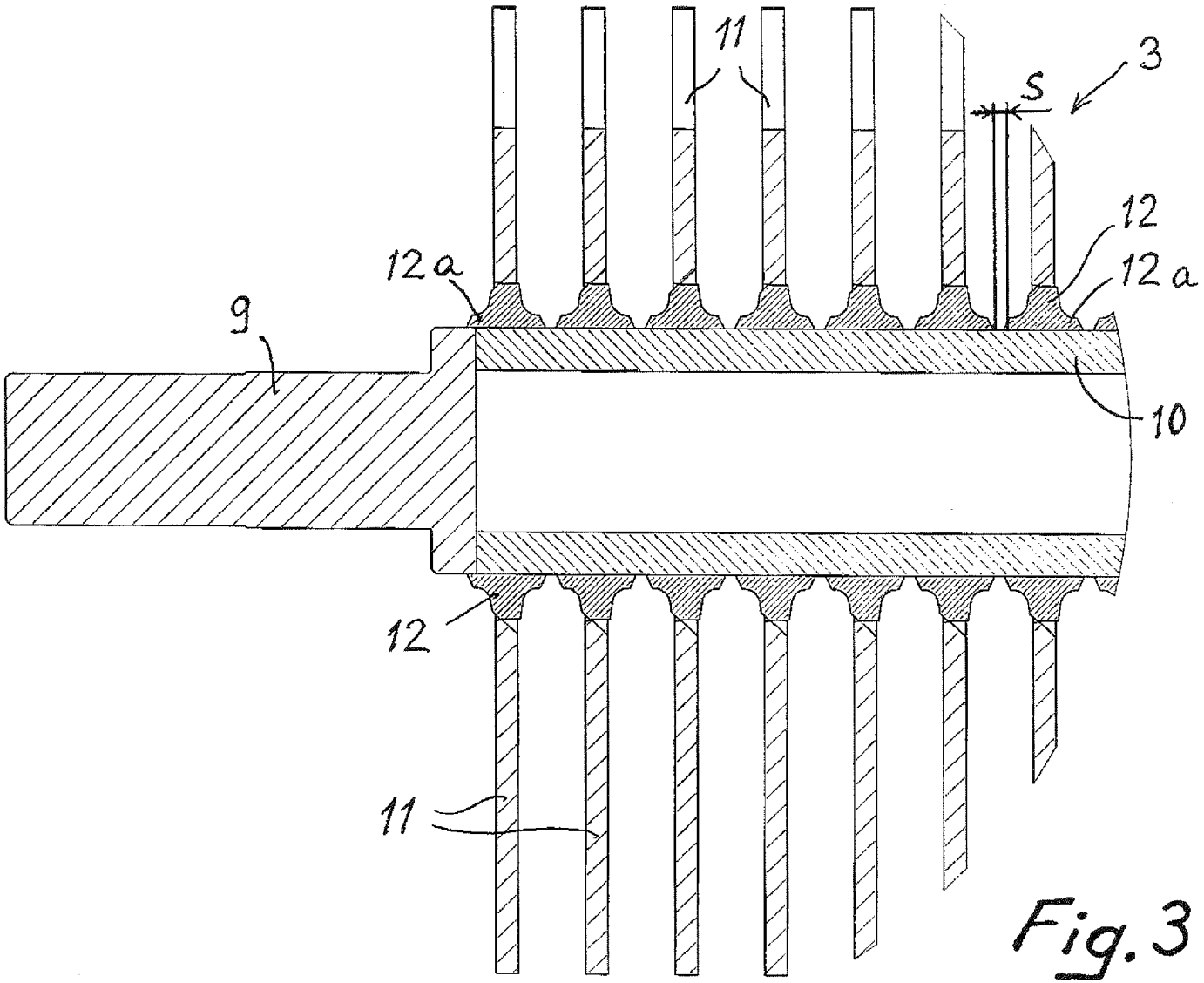
FIG. 3 shows an enlargement of a detail at III in FIG. 1.

The bucket comprises a bottom plate 1, side walls 2, and working drums 3, which are rotatable about their axes at a rear part of the bucket and which, while in rotation, are capable of screening, crushing or mixing a material present in the bucket and at the same time delivering a screened, crushed or mixed material out of the bucket between or through the working drums 3. Between tool flanges 11' of the working drums 3 can be fitted various types of crushing teeth, not shown. Alternatively, as illustrated in FIGS. 2 and 4, tool flanges 11 can be designed as pointed star-shaped plates, said points being formed with rounded tips.

The side walls 2 have rear parts thereof provided with enclosures 4 for a transmission and bearing assemblies of the working drums 3. The enclosures 4 feature external side walls 4*a* and, in the depicted embodiment, the enclosures 4 are partitioned from an interior of the bucket by means of frame panels 5 which can be fitted with bearing cups 6 for the working drums 3. In this particular case, the frame panels 5 are present as a direct extension of the side walls 2 and made of the same sheet material as the side walls 2.

The frame panels 5 are provided with take-up and attachment formations for the working drums 6, to which the working drums 3, along with the bearings 6 thereof, are introducible and mountable as a single assembly from a rear-facing side of the bucket.

In the depicted exemplary embodiment, the working drums 3 are horizontal in an operative position of the bucket, but can be vertical as well. In the present case, however, the frame panels 5 lie in a space between the external side walls 4*a* of the enclosures 4 at a distance from the external side walls 4*a*, resulting in the gear and bearing enclosures 4 between the external side walls 4*a*. A fastening collar for the bearing cups 6, which encircles the bearing cups, is fastened by screws of bolts to the frame panel 5.

The gear and bearing enclosures 4 are closable from behind by removably mounting backwall panels (not shown) on a rear-facing side of the bucket.

Novel about the invention is a configuration of the working drums 3, one preferred exemplary embodiment thereof being now described in reference to FIGS. 1-4.

Each tool flange is fixed to a drum shaft 9, 10 by means of a spacing ring 12 set between every tool flange 11 and the drum shaft. The spacing ring 12 is provided with a butt collar or butt extension 12*a*, extending around the drum shaft 9, 10 and dimensioned in the drum shaft direction in such a way that, with the tool flanges 11 at a desired distance from each other, between the butt collars or extensions 12*a* remains a gap (s) for a welded joint. Two tool flanges 11 and the drum shaft 9, 10 are attached together by a single welded joint present in this gap (s).

The tool flange 11 and the spacing ring 12 are first coupled together by welding a joint from either side of the plate-like tool flange as an independent operation. Hence, this welded joint becomes fatigue resistant. This is followed by setting the tool flanges 11 on the drum shaft 9, 10 and by welding a circumferential seam in the gap (s). Thus, in this preferred embodiment of the invention, the wear resistant plate-like tool flange 11 is attached to the drum shaft by means of a separate spacing ring 12.

The configuration according to the invention enables using a single welding operation for joining two tool flanges and a drum shaft together. Thus, the weld can be eliminated from the area of a powerful strain. The configuration is also beneficial in the sense that the welding operation can be performed in a radial direction of the working drum at an optimal angle relative to the gap (s). A problem with the prior known structure lies in the fact that tool flanges must be welded directly to the drum shaft one at a time, whereby the welding process can only be carried out from one side. Thus, the weld is not of very high quality at the root side.

In the described embodiment, the drum shaft is a cross-sectionally circular pipe 10, having its ends fitted with end pieces 9 which are adapted to accommodate the bearing cups 6 and drive gears 7. The drum shaft may also be a polygon in cross-section, e.g. a square pipe or a rectangle, which is produced by welding together two U-beams with tops of the legs facing each other.

The invention is not limited to the above-described embodiment. For example, the spacing ring 12 is necessarily needed as the butt collars or extensions 12*a* can be made directly in the tool flanges 11 in order to enable coupling two tool flanges and a drum shaft together by a single welding operation.

What is claimed is:

1. A screening, crushing or mixing bucket, which is designed as the bucket of an excavating machine or a bucket loader, comprising:

a bottom plate;

side walls; and working drums, which are rotatable about their axes at a rear part of the bucket and which, while in rotation, effect screening, crushing or mixing of a material present in the bucket and at the same time delivering of a screened, crushed or mixed material out of the bucket between or through the working drums, as well as enclosures for a transmission and bearing assemblies of the working drums, said enclosures being defined by frame panels capable of being fitted with bearing cups for the drums, wherein:

tool flanges are provided with a butt collar or butt expansion, extending around the drum shaft and dimensioned in the drum shaft direction in such a way that, with the tool flanges at a desired distance from each other, between the butt collars remains a gap for a welded joint; and that two tool flanges and the drum shaft are attached together by a single welded joint present in said gap.

2. A bucket as set forth in claim 1, wherein between the tool flanges and the drum shaft is a spacing ring, which is provided with said butt collar or butt expansion surrounding the drum shaft, and which spacing ring is fastened to the tool flange by welding.

3. A bucket as set forth in claim 2, wherein the spacing ring is fastened to the tool flange by a welded joint prior to mounting the tool flange on the drum shaft.

4. A bucket as set forth in claim 2, wherein the drum shaft in cross-section is a circular or polygonal pipe, having its ends fitted with end pieces adapted to accommodate the bearing cups and drive gears.

5. A bucket as set forth in claim 1, wherein the tool flanges are pointed star-shaped plates, said points being formed with rounded tips.

6. A bucket as set forth in claim 3, wherein the drum shaft in cross-section is a circular or polygonal pipe, having its ends fitted with end pieces adapted to accommodate the bearing cups and drive gears.

7. A bucket as set forth in claim 2, wherein the tool flanges are pointed star-shaped plates, said points being formed with rounded tips.

8. A bucket as set forth in claim 3, wherein the tool flanges are pointed star-shaped plates, said points being formed with rounded tips.

9. A bucket as set forth in claim 4, wherein the tool flanges are pointed star-shaped plates, said points being formed with rounded tips.

10. A bucket as set forth in claim 6, wherein the tool flanges are pointed star-shaped plates, said points being formed with rounded tips.

* * * * *